United States Patent [19]

Boatwright et al.

[11] 3,997,300

[45] Dec. 14, 1976

[54] BLACK LIQUOR OXIDATION APPARATUS

[75] Inventors: William H. Boatwright; Thomas C. Hsu, both of Covington, Va.

[73] Assignee: Westvaco Corporation, New York, N.Y.

[22] Filed: Sept. 16, 1975

[21] Appl. No.: 613,908

Related U.S. Application Data

[62] Division of Ser. No. 451,764, March 18, 1974, Pat. No. 3,928,531.

[52] U.S. Cl. ..... 23/284; 23/262; 23/260; 23/285; 261/124; 261/121 R; 159/47 WL; 423/206 R; 423/514; 162/30 K

[51] Int. Cl.[2] ..... D21C 11/14; B01J 10/00

[58] Field of Search ..... 23/284, 283, 262, 260, 23/285; 261/124, 121 R; 159/47 WL; 162/30 K; 423/206, 514

[56] References Cited

UNITED STATES PATENTS

| | | | |
|---|---|---|---|
| 2,486,693 | 11/1949 | Spijker et al. | 23/285 X |
| 3,081,289 | 3/1963 | Cheney et al. | 261/124 X |
| 3,849,059 | 11/1974 | Filippov et al. | 261/124 X |

*Primary Examiner*—James H. Tayman, Jr.
*Attorney, Agent, or Firm*—W. Allen Marcontell; Richard L. Schmalz

[57] ABSTRACT

Gas-liquid contact reaction efficiency in a two stage heavy black liquor oxidation process is improved by co-current contact in the first stage and countercurrent contact in the second stage or vice versa. Such improved efficiency is sustained by preventing the obstruction of gas discharge nozzles. Gas discharge nozzle flow and distribution is sustained at design levels pursuant to distribution system parameters constructed substantially according to the relation $$\frac{A_{out}}{A_{in}} \leq .95 \left[ \frac{L/D}{70} \right].$$

4 Claims, 8 Drawing Figures

BLACK LIQUOR OXIDATION APPARATUS

CROSS-REFERENCE TO RELATED APPLICATION

This is a division of application Ser. No. 451,764 filed Mar. 18, 1974 and allowed as U.S. Pat. No. 3,928,531.

BACKGROUND OF THE INVENTION

1. Field of the Invention

The present invention relates to that step in the kraft wood pulping process chemical recovery flow stream where sodium sulfide present in the expended cooking chemical (black liquor) is oxidized in a gas-liquid contact reaction environment to one of the more stable compounds of sodium thiosulfate and/or sodium sulfate. The subject process step is generically characterized in the industry as black liquor oxidation and has the purpose of preventing the release of toxic, gaseous hydrogen sulfide which, otherwise, would reactively evolve within and uncontrollably emanate from the direct contact evaporation stage of the recovery stream.

2. The Prior Art

As a technological specialty, black liquor oxidation has approximately 25 years of development. Although the basic functional concept is quite simple, e.g., intimately contacting the black liquor stream with a reactively free source of oxygen, at least six distinct approaches to the objective were identified by E. T. Guest in his "Developments In Black Liquor Oxidation" published in the December, 1965 issue of Pulp and Paper Magazine of Canada. The present invention may be classified in the E. T. Guest category of "air pressure systems."

In terms of equipment design and complexity, the air pressure system may be characterized as the most simple of the several alternatives and basically comprises an unpressurized liquor retention vessel wherein liquor is introduced at the top and withdrawn from the bottom. Simultaneously, air or oxygen is injected into the reservoir near the bottom thereof from a plurality of nozzles distributed over the vessel section. Since the bubbles of gaseous oxygen buoyantly migrate toward the vessel top, the relative gas-liquid flow is countercurrent.

J. E. Landry in his December, 1963 TAPPI Vol. 46, No. 12 presentation of "Black Liquor Oxidation Practice And Development — A Critical Review" describes, on page 769 thereof, the operation of a classical "air pressure system" in greater detail.

U.S. Pat. Nos. 3,549,314 and 3,567,400 issued to I. S. Shah disclose hybrid modifications of the classical "air pressure system."

Operationally, the technical objectives of black liquor oxidation systems include the oxidative stabilization of sodium sulfide present in kraft black liquor by chemically transforming it to sodium thiosulfate and/or sodium sulfate. By virtue of this expedient, loss of economically valuable sulfur to the atmosphere is prevented. Without the black liquor oxidation expedient, such losses occur in the form of gaseous hydrogen sulfide and methyl mercaptans which hydrolytically evolve from the final liquor concentration step performed by the direct contact evaporator. Moreover, the compounds, hydrogen sulfide and methyl mercaptan, are highly toxic and malodorous and therefore highly objectionable to the surrounding community.

At the present state of the black liquor oxidation art development, virtually 100% of the sodium sulfide present in a black liquor flow stream may be reactively converted by an air pressure system operating at design conditions.

However, much is left to be desired in the form of efficient, normalized retention times and the operational continuance of design conditions.

The normalized retention time of a particular black liquor oxidation process and apparatus is the product of the calculated time interval required for flowing one unit of vessel volume through the system, in minutes, multiplied by the proportionality of oxygen actually supplied to the oxygen quantity stoichiometrically required to react all of the sodium sulfide present in a given unit of black liquor. Mathematically, normalized retention time may be expressed as:

$$T_n = \text{Liquor Retention Time} \times \frac{O_2 \text{ Supplied}}{O_2 \text{ Stoichiometric}}$$

Prior art oxidation systems achieve 95 to 99% sodium sulfide removal with 200 to 3000% excess oxygen in 15 to 200 minutes. Depending on the performance efficiency of such prior systems, they may be judged from good to poor.

The design of a practical, efficient, black liquor oxidation system comprises numerous compromises. To flood the reservoir with large excesses of oxygen is a heavy tax against the system economics. If the oxygen is purchased in pure form, most is wasted to buy retention time. If the oxygen is derived from compressed air, the time is purchased with huge power consumptions. If large, 200 – 300 minutes, actual reaction times are used, such time is purchased with large capital expenditures on tank volume and real estate, whether in a single tank or a plurality of smaller tanks operated in series or parallel flow.

In addition to the foregoing, most prior art systems suffer nozzle plugging within a relatively short order of time after start-up. Although the total oxygen flow rate may remain relatively unchanged after plugging of 10 to 15% of the originally available nozzles, system performance falls off considerably due to the consequent, maldistribution of oxygen within the reservoir. If allowed, obstruction of up to 80% of the original nozzle area may occur within 60 days of continuous operation. Accordingly, most prior art systems are shut down each 1 to 3 days for a few hours to soak the accumulated nozzle deposits and subsequent back flushing.

While the mechanics of such nozzle plugging are not completely known, one contributing factor is the lack of uniformly adequate pressure distribution throughout the oxygen supply system. Analysis of plugging patterns in prior art distribution systems reveals a propensity of such systems to suffer initial plugging at those nozzles most proximate of the air supply line juncture with the main manifold. One explanation of this phenomenon relates to the Bernoulli function of $$P_t = P_s + P_d$$

where:

$P_t$ is total pressure $P_s$ is static pressure $P_d$ is dynamic or inertial pressure According to the explanative theory, the air supply flow experiences a velocity increase in the juncture region of the supply line with the main manifold where, in prior art systems, the total mass flow is allowed to divide into two flow streams from the juncture point. Flow area for the two exit streams is substantially more than flow for the entrance stream. Since the total pressure $P_t$ must remain constant, an increase in the dynamic pressure $P_d$ is gained at a sacrifice in static pressure $P_s$. However, since flow from the main header into the subheaders is transverse of the dynamic pressure force vector, the only available driving force to induce mass flow into the subheaders is the static pressure $P_s$. Accordingly, if a moving air mass is accelerating along a subheader axis into and from a lateral subheader junction point, such acceleration increase in velocity supplements the $P_d$ parameter of the Bernoulli function at the sacrifice of $P_s$. Consequently, relatively less mass enters the subheader thereby resulting in a lower pressure differential across the throat of those injection nozzles nearest the supply line junction.

In consideration of the aforedescribed prior art, an objective of the present invention is to improve the operational efficiency of pressurized air, black liquor oxidation systems.

Another objective of the present invention is to operationally sustain such improved performance of a pressurized air, black liquor oxidation system by eliminating nozzle plugging due to poor air distribution.

A further objective of the present invention is to teach a self-draining air distribution system having no liquid stagnation point whereby liquor which is permitted to back flow into the air system during periods of operational interruption may be purged from the air system by pressure differential and gravity upon resumption of operation.

BRIEF SUMMARY OF THE INVENTION

The present invention basically comprises an unpressurized tank serving as a reaction vessel for a given quantity of black liquor.

The reaction vessel is partitioned into two volumes by a fluid impermeable barrier of height less than that of the vessel.

Pressurized air is injected into the vessel by a finite number of nozzles uniformly distributed over the tank area in both volumetric portions near the vessel bottom. Air is supplied to the nozzles by a manifold distribution system constructed in the manner taught herein to assure a uniform pressure ratio across the nozzle throats of all nozzles in a respective volumetric portion.

Sodium sulfide laden black liquor is continuously introduced to the first volumetric portion near the bottom thereof and flows co-current with the air bubble migration to the first volume top as defined by the upper edge of the partition between the volumes. Accordingly, black liquor flow into the second volumetric portion is from the top thereof over the partition upper edge.

Black liquor is continuously removed from the second volumetric portion near the bottom thereof thereby effecting counter-current flow in said second volume relative to the buoyant migration of air bubbles.

Design guidelines are disclosed herein to teach the construction of an 800 gpm black liquor oxidation system achieving 98–99% $Na_2S$ removal in approximately 100 minutes normalized retention time from an approximately 50% excess air supply.

BRIEF DESCRIPTION OF THE DRAWINGS

Relative to the drawings wherein like reference characters denominate like parts throught the several figures.

DESCRIPTION OF THE PREFERRED EMBODIMENT

Figure 1:
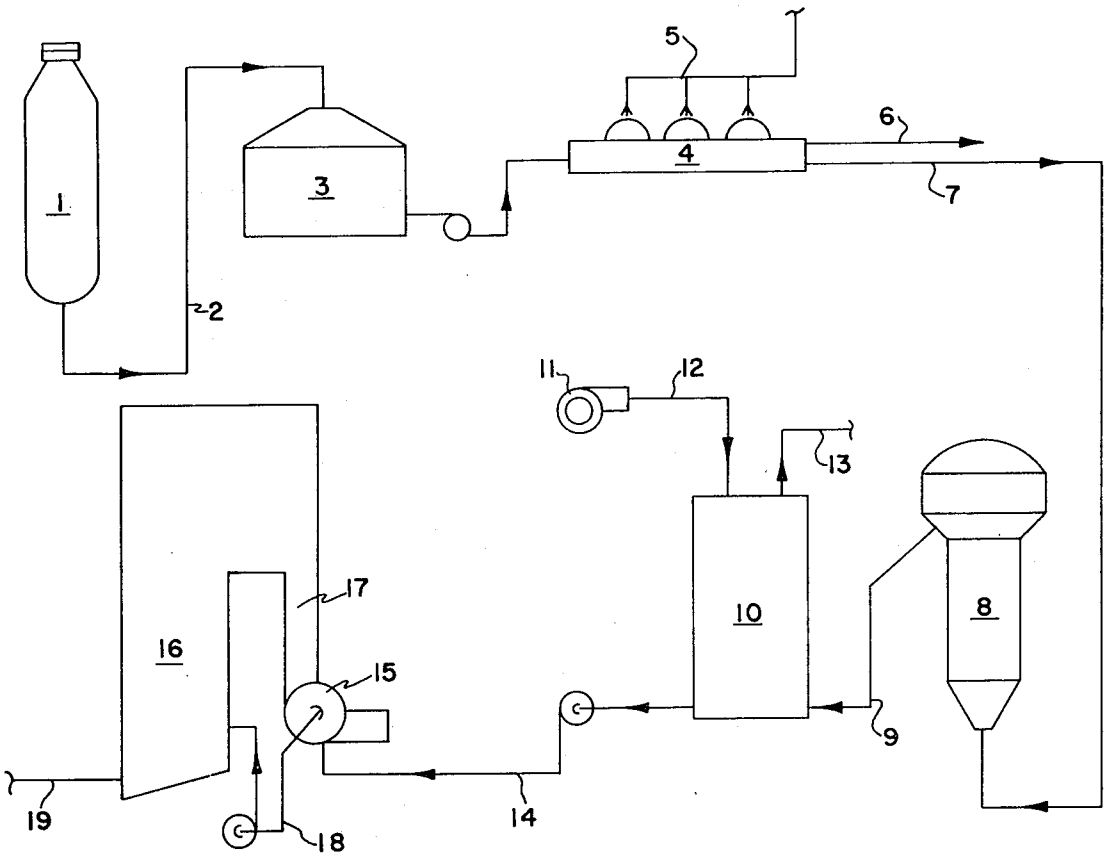
FIG. 1 is a process flow schematic of the present invention shown in combination with the chemical recovery system of a conventional kraft pulping mill.
Figure 2:
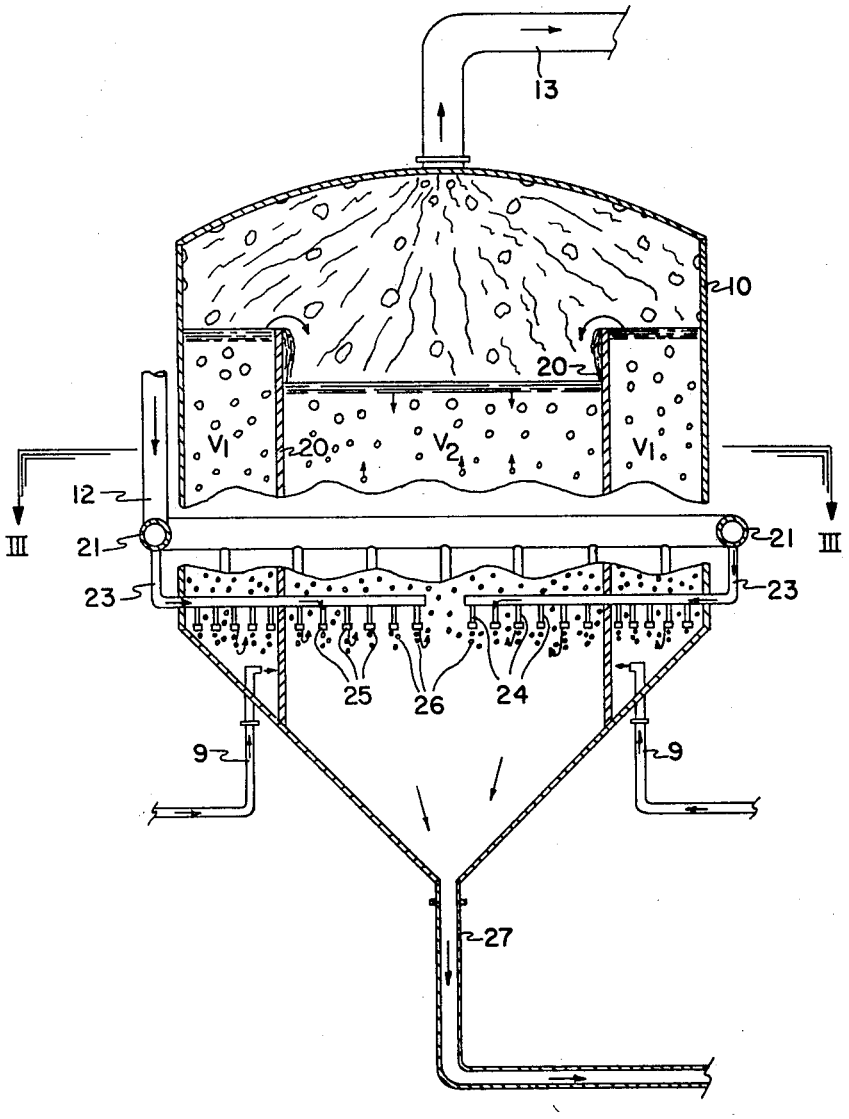
FIG. 2 is a sectional elevation of the apparatus taught to practice the subject process.
Figure 4:
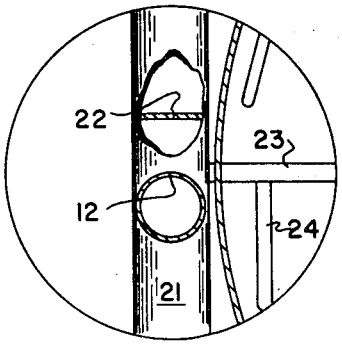
FIG. 4 is an enlarged detail of that portion of FIG. 3 within the circle IV.
Figure 3:
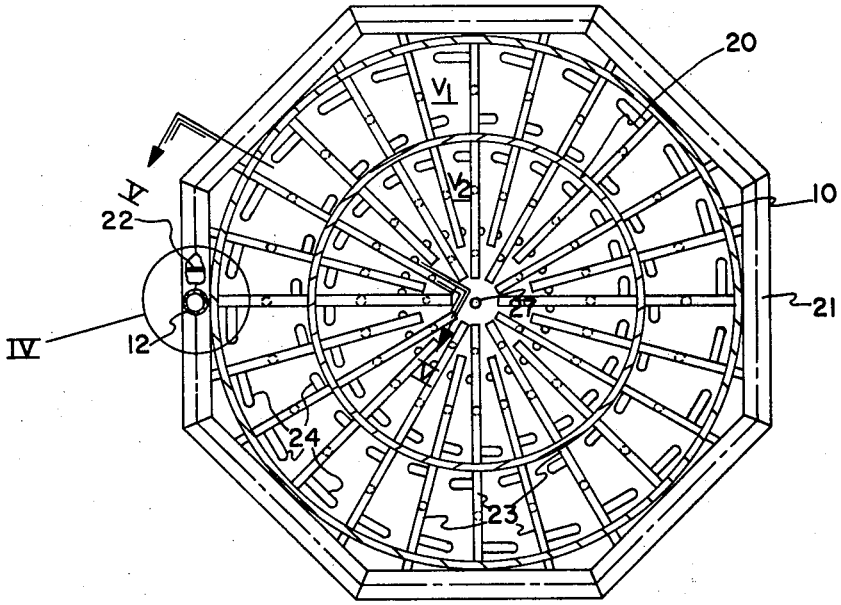
FIG. 3 is a sectional plan of the apparatus illustrated by FIG. 2 taken at the section line III—III of FIG. 2.

With reference to FIG. 1, that portion of the papermaking technology to which the present invention relates begins with the wood digester 1 which confines a charge of wood chips in a thermochemical environment for a discrete period of time to reactively weaken and dissolve the lignin bond between cellulose fibers. Thereafter, the mixture of fiber and chemical is discharged through a blow line 2 into a blow tank 3 to reduce the pressure thereof to atmospheric.

Next, tthe fiber and chemical mixture is subjected to a series of washing stages 4 to separate the lignin laden cooking chemical from the fiber. Wash water line 5 may carry clean or fresh water to the final wash stage whereas dilute filtrate from the final wash stage may constitute wash water for first stage washing.

Heavily laden washer filtrate no longer suitable for additional wash stage cycling is characterized as weak black liquor and constitutes approximately 15 to 20% solids which, for the most part, are complex organic compounds of lignin, sodium and sulfur.

The weak black liquor is carried by conduit 7 from the washers 4 to an evaporation facility 8 represented here as a multiple effect, long tube evaporator. Solids concentration in the black liquor flow stream is increased to the order of 45 to 50% by evaporative removal of the aqueous vehicle. Concentrated black liquor flowing from the evaporator 8 in conduit 9 is characterized as heavy black liquor and is the material to which the preferred embodiment of the invention relates. It should be understood, however, that by appropriate modification, obvious to those of ordinary skill in the art, the subject invention may also be deployed in the weak black liquor flow stream 7.

Heavy black liquor is introduced by conduit 9 to oxidation reaction vessel 10 where the heavy black liquor is subjected to a liquid - gas contact combination with oxygen supplied in the form of air from a compressor 11 through an air distribution system or header 12. More concentrated oxygen sources from bottled supplies, for example, are obvious alternatives to compressed air.

Conduit 13 represents a vent for the unreacted and excess gases following liquor contacting to escape the confinement of vessel 10. Since the liquor flow stream may contain varying and uncontrollable amounts of soap, a valuable by-product, conduit 13 may also carry soap containing foam issuing from the liquor reservoir in vessel 10 to an unpressurized foam collection vessel.

Following the oxidation step, the black liquor flow stream is directed by conduit 14 into a direct contact evaporator 15 where the solids concentration is further increased to approximately 65%. In this highly concentrated state, the black liquor flow stream constitutes fuel for a steam boiler 16 having a heat value of approximately 6,600 to 10,000 BTU/lb. Conduit 18 directs the 65% liquor flow stream from the direct contact evaporator 15 to the burner heads of boiler 16.

Steam generated by liquor combustion in boiler 16 is used as heat energy support of the evaporator 8, web drying on the papermachine and possibly for some electric power generation.

Waste heat from boiler 16 in the form of flue gases is directed by conduit 17 into the direct contact evaporator 15.

Residuals from liquor combustion, predominately comprising sodium carbonate and sodium sulfide, as drawn from the boiler 16 hearth as smelt via conduit 19 and directed to additional process stations for clarification and causticizing to reclaim available chemical values for fresh, or white liquor makeup.

Since the present invention is focused on the process and apparatus of oxidation vessel 10, further attention will be directed thereto as represented by FIGS. 2 through 6.

As illustrated, vessel 10 is a cylindrical tank segregated, by a concentric cylindrical fluid barrier 20, into at least two volumetric portions $V_1$ and $V_2$. The relative sizes of volumes $V_1$ and $V_2$ are analytically determinable functions of the liquor sodium sulfide concentration within the liquor, the liquor mass flow rate, the reactive air mass flow rate and an economic time allowed for reactive residence. The quantitative relationship between these functions shall be developed more fully below.

The air distribution system within tank 10 comprises a header pipe 12 in communication with a ring manifold 21. Pipe blank 22 is positioned within manifold 21 to limit air flow within the manifold to one direction from the header junction.

Equally distributed above the internal periphery of manifold 21 and in fluid communication therewith are a plurality of subheaders 23. Each subheader 23 is provided with a plurality of nozzle legs 24 to communicate nozzles 25 with respective subheaders.

Ideally, vertical positionment of the air distribution system above the tank 10 bottom is predicated on the design preference that the air jet streams 26 should terminate in the first stage at a point below the nozzles 25 approximately level with the heavy black liquor inlet line 9. Similarly, air jet streams 26 in the second stage should terminate approximately level with the liquor discharge conduit 27.

The length of the air discharge jet 26 is predicated on the pressure differential between the air supply and the static liquor pressure due to liquid head and any back pressure present in the air space above the liquor surface within the tank. Furthermore, the liquid head in volume $V_2$ is not necessarily equal to the liquid head in volume $V_1$. Therefore, the vertical separation distances between nozzles 25 and the inlet 9 and outlet 27 conduit, respectively, are not necessarily equal.

As a further consideration to vertical placement of the nozzles within tank 10, is the distinction of co-current up-flow of the liquor and gas in the first contact stage of volume $V_1$ and counter-current flow in the second contacting stage $V_2$. Since maximum residence time of contact between the liquor and air is an economic objective, the counter-current relative flow between the gas and liquor in volume $V_2$ will usually operate to make the vertical separation distance between the air nozzle 25 and the liquor discharge conduit 27 greater in volume $V_2$ than in volume $V_1$. Accordingly, if maximum tank volume is to be exploited, liquor discharge conduit 27 will be located as close to the tank 10 bottom as practical and the nozzles 25 will be appropriately positioned relative thereto.

Conversely, inlet conduit 9 in volume $V_1$ will be appropriately positioned relative to the elevation of nozzle 25 as previously dictated.

Soap is a valuable by-product of the wood pulping process and, in some recovery flow streams, is present in the black liquor at this point. As a consequence of the soap presence, when the liquor volume in tank 10 is agitated by gas percolation, foam is generated. To relieve tank 10 of possible back pressure due to such foam, a vent line 13 is provided to channel same to a receiver vessel, not shown, for by-product recovery.

As stated previously, the relative sizes of tank volumes $V_1$ and $V_2$ are analytically determinable functions of the liquor sulfide concentration, liquor flow rate and air supply rate. To make such determinations, certain properties of the liquor, such as the oxidation kinetic characteristics, must be experimentally developed and other conditions must be assumed.

Figure 7:
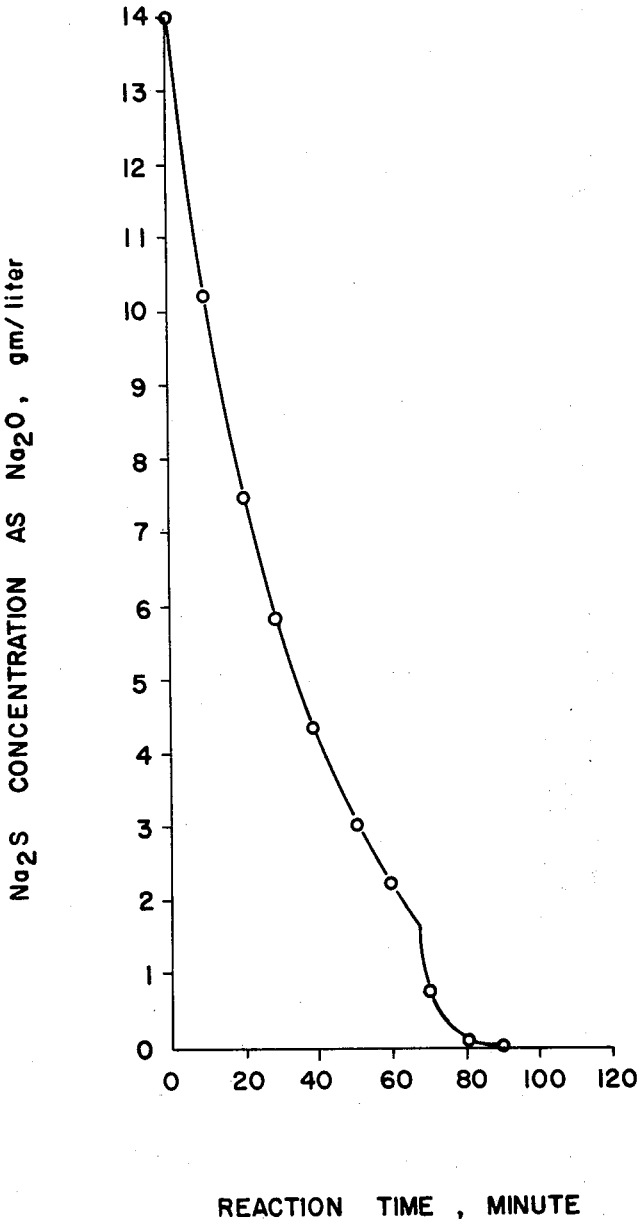
FIG. 7 is a graphic representation of the $Na_2S$ concentration - Time relationship under particular oxidation reaction conditions.

Initially, it is necessary to determine the oxidation reaction rate characteristics of the liquor as represented graphically by FIG. 7. This curve shows the $Na_2S$ concentration vs time relationship of a fixed volume of representative liquor percolated by an up flow of air at a known rate. The slope of the smoothed, experimental, concentration - time relationship, at any specific reacting concentration, is the reaction rate, r, of the liquor under the respective conditions in units of mass/volume × time, e.g. grams/liter − min. For purposes of facilitating analysis however, the same FIG. 7 data is presented by FIG. 8 as a linearized expression by plotting a log concentration vs time relationship. The resultant straight line relationship is indicative of a first order reaction. Accordingly, the slope of the FIG. 8 curve is the reaction rate constant, k, expressed in units of 1/time, e.g. 1/minute.

Figure 8:
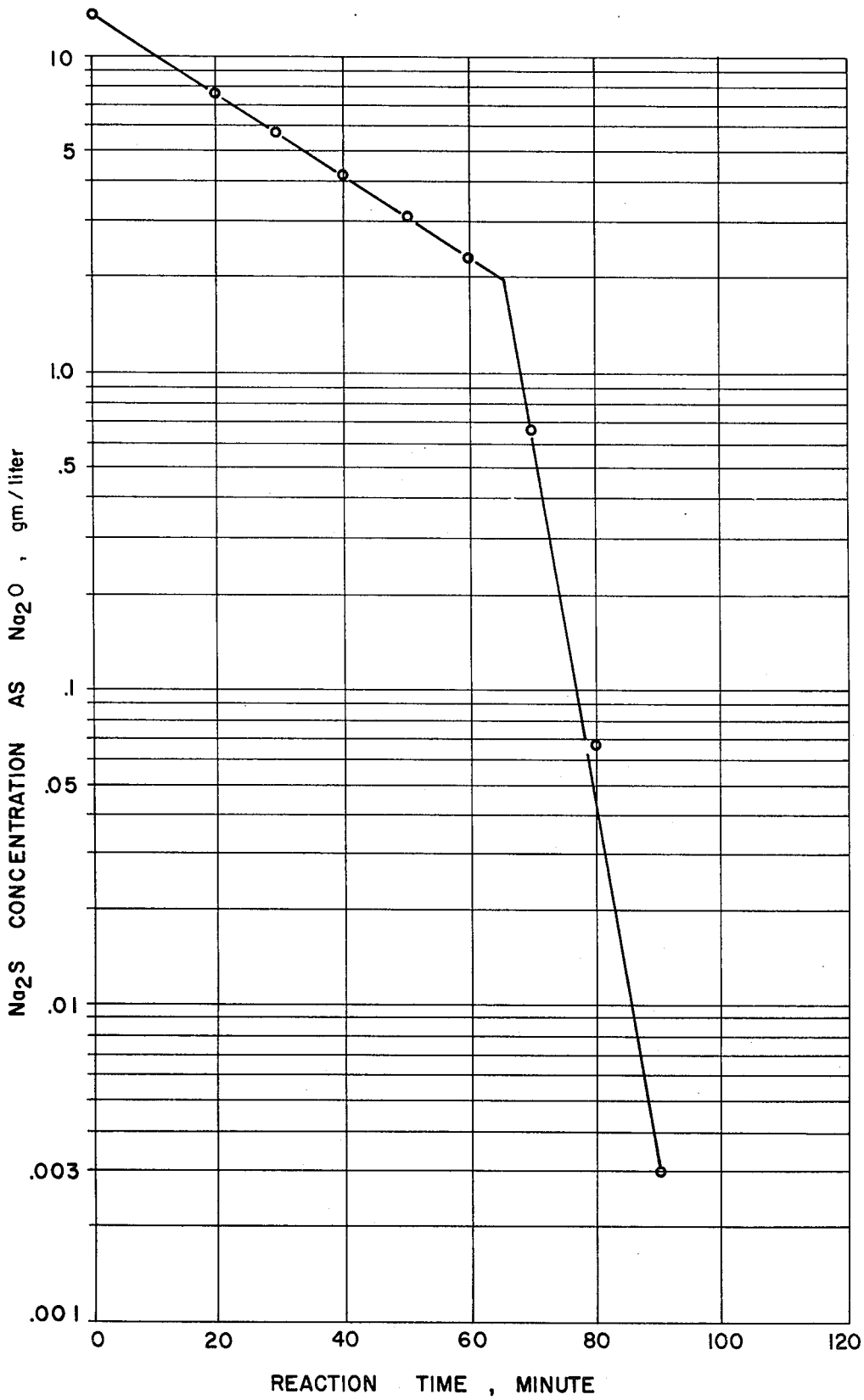
FIG. 8 is a graphic representation of the FIG. 7 relationships but wherein the $Na_2S$ concentration factor is plotted along a log scale.

Regarding the particular volumetric flow rate of air per unit of liquor volume selected for use, 0.445 SCFM air/ft.$^3$ liquor relates to the FIGS. 7 and 8 data. A different air to liquor ratio would yield a different reaction rate *r*, and hence, a different slope of the concentration - time curve. Ratio selection is largely a matter of experimental experience and economics.

Existing mill conditions dictate the inlet concentration, $C_i$ of $Na_2S$ (expressed as $Na_2O$) in the liquor flow stream. An environmentally safe level of emission tolerance dictates the maximum $Na_2S$ exit concentration, $C_o$.

Similarly, mill size will dictate the total liquor flow rate.

From these facts and assumptions, basic engineering construction criteria for a particular system may be derived. The following example will illustrate the derivation process.

Initially, it should be understood that the purpose of the following example is to teach the interrelationships of numerous design parameters; some analytically derived, some experimentally derived and some empirically derived. Basically, the final design approach of the air distribution system is of the trial and error technique to achieve a balanced, 2-fluid flow system. In the interest of brevity, however, only a preliminary design loop will be developed herein. Accordingly, many of the design considerations previously described will be ignored.

DEFINITIONS:

$V_1$ = First theoretical reaction volume of liquor oxidation tower 10.

$V_2$ = Second theoretical reaction volume of liquor oxidation tower 10.

$V_T = V_1 + V_2$ = Total theoretical reaction volume of liquor oxidation tower 10.

$r_1$ = Oxidation reaction rate within $V_1$, e.g. gm/liter-min.

$r_2$ = Oxidation reaction rate within $V_2$, e.g. gm/liter-min.

$k_1$ = Reaction rate constant with $V_1$, e.g. 1/min.

$k_2$ = Reaction rate constant within $V_2$, e.g. 1/min.

$C_i$ = Concentration of $Na_2S$ expressed as $Na_2O$ in liquor at inlet $V_1$, e.g. gm/liter.

$C_o$ = Concentration of $Na_2S$ expressed as $Na_2O$ in liquor at inlet $V_2$, e.g. gm/liter.

$C_m$ = Concentration of $Na_2S$ expressed as $Na_2O$ in liquor at exit of $V_1$ and entrance of $V_2$, e.g. gm/liter.

F = Liquor flow rate, e.g. gal/min.

Assuming negligible volume change in oxidation and using the standard back mix reactor design equation, $$-r_1 = k_1C_m = F/V_1\,(C_i - C_m) \quad 1.$$

$$-r_2 = k_2C_o = F/V_2\,(C_m - C_o). \quad 2.$$

Accordingly, from equations (1) and (2), respectively, $$V_1 = \frac{F}{k_1}\left(\frac{C_i}{C_m} - 1\right) \quad (3)$$

$$V_2 = \frac{F}{k_2}\left(\frac{C_m}{C_o} - 1\right). \quad (4)$$

Since $V_1 + V_2 = V_T$:

$$V_T = F\left[\frac{1}{k_1}\left(\frac{C_i}{C_m} - 1\right) + \frac{1}{k_2}\left(\frac{C_m}{C_o} - 1\right)\right]. \quad (5)$$

When $dV_T/dC_m$ 0, $V_T$ is minimum, $$\frac{d\,V_T}{d\,C_m} = F\left[\frac{1}{k_2}\left(\frac{1}{C_o}\right) - \frac{1}{k_1}\left(\frac{C_i}{C_m}\right)\right] = 0$$

Since F $\neq$ 0, therefore:

$$\frac{1}{k_2}\left(\frac{1}{C_o}\right) - \frac{1}{k_1}\left(\frac{C_i}{C_m^2}\right) = 0. \quad (6)$$

If $k_1 = k_2 \neq 0$, from equation (6), $$\frac{1}{C_o} - \frac{C_i}{C_m^2} = 0,$$

and therefore:

$$C_m = \sqrt{C_iC_o} \quad 7.$$

is optimum.

If $k_1 \neq k_2$, from equation (6), $$C_m = \sqrt{\frac{k_2}{k_1} \cdot C_i \cdot C_o} \text{ is optimum.} \quad (8)$$

is optimum.

Assuming, initially, that $k_1 = k_2$, then equation (7) will be applicable. Whether this assumption is correct or not may be checked with experimental data. Consequently, if $k_1 = k_2$ and applying $dV_T/dC_m = 0$, $$V_T = V_1 + V_2$$

is minimum when $$V_1 = V_2.$$

Such shall be the basis for the further development of this example. Accordingly, it shall be necessary first, from the available design specifications of $C_i$ and $C_o$, to calculate the optimum $C_m$ according to equation (7). With the calculated $C_m$ and the experimentally obtained $k_1$ and $k_2$, which in this example are assumed to be equal, the optimum $V_T$ is then determined according to equation (5). Flow rate, F, is also one of the design specifications that has been given beforehand.

Because of the economic and design simplicity of providing a single air distribution manifold to uniformly distribute the total requisite air supply over the tank area, regardless of how the tank 10 may be divided by partition 20, the same mass quantity of air per unit volume of liquor is supplied to each volume $V_1$ and $V_2$. This expedient is not a design limitation however, and, if desired, provision may be made to provide one reaction volume with a greater supply of air per liquor volume than the other. In such case, the respective volumes would be sized pursuant to equations (3), (4) and (8).

Continuing with the example, the pilot data of FIGS. 7 and 8 were obtained with a quiescent liquor volume of 3500 gallons or about 470 ft.$^3$. The cylindrical dimensions for this volume were 9.4 ft. in height and 8 ft. in diameter. A batchwise oxidation of this liquor volume was conducted with a constant 208 SCFM flow rate of air to obtain the oxidation reaction kinetic data for this particular design. Temperature of the pilot reaction system, T, was 200° F (660° R).

The initial $Na_2S$ concentration, $C_i$, in the pilot liquor volume was 14 gm/liter expressed as $Na_2O$.

Normal to back mix reaction systems such as described for the pilot system, the outlet $Na_2S$ concentration, $C_o$, is always very low compared to that of the inlet, $C_i$. Hence, for the purpose of selecting a specific value for the reaction rate constant, $k$, the outlet concentration, $C_o$, is taken as the control parameter. By observation from FIG. 8, the reaction characteristics of this particular system include two distinct slopes to the curve. The selected outlet concentration, $C_o$, of 0.10 gm/liter clearly falls on the lower segment of the FIG. 8 curve. This lower curve segment of FIG. 8 represents a first order rate mechanism displayed in semi-log fashion.

From experimental data, the $Na_2S$ is observed to have diminished over the lower curve segment of FIG. 8 from 0.6 gm/liter to 0.06 gm/liter in 9 minutes.

Definitively:

$$V = dC/dt = -k_C$$

Rearranging and integrating:

$$\int \frac{d_C}{C} = -\int k dt$$

$$\ln C \frac{C_2}{C_1} = -k(t_2 - t_1)$$

Therefore:

$$k = \frac{-\ln \left(\frac{C_2}{C_1}\right)}{\Delta t}$$

Calculating $k$ for this case:

$$k = \frac{-\ln \frac{0.06}{0.6}}{9 \text{ min}}$$

-continued $$= \frac{-(-2.3026)}{9 \text{ min}}$$

$$k = 0.2558 \frac{1}{\text{min}}$$

The aforedescribed analytical and pilot derived data will now be applied to a full scale system wherein:

F = 800 GPM = 3028 liter/min
$C_i$ = 20 gm/liter
$C_o$ = 0.1 gm/liter
T = 660° R Determining first, the optimum intermediate concentration $C_m$ from the inlet and outlet concentrations, $C_i$ and $C_o$, respectively, and continuing with the assumption that $k = k_1 = k_2 = 0.2558$ 1/min, from equation (7):

$$C_m = \sqrt{C_i \cdot C_o} = \sqrt{20 \times 0.1} = 1.414 \text{ gm/liter}$$

At this point, the assumption that $k = k_1 = k_2 = 0.2558$ 1/min may be verified. The value of $C_m$, the outlet concentration of the first reaction stage, analytically determined to be 1.414 gm/liter, is compared to the FIG. 8 curve and found to fall along the lower segment thereof. Accordingly, the reaction rate constant $k_1$ of the first reaction stage is conclusively established as the same as the rate constant $k_2$ of the second reaction stage.

The total theoretical reactor volume $V_T$ may now be calculated from equation (5):

$$V_T = F\left[\frac{1}{k_1}\left(\frac{C_i}{C_m} - 1\right) + \frac{1}{k_2}\left(\frac{C_m}{C_o} - 1\right)\right]$$

Since $k_1 = k_2 = k$, $$V_T = \frac{F}{k}\left[\left(\frac{C_i}{C_m} - 1\right) + \left(\frac{C_m}{C_o} - 1\right)\right]$$

$$= \frac{3028}{.2558}\left[\left(\frac{20}{1.414} - 1\right) + \left(\frac{1.414}{0.1} - 1\right)\right]$$

$V_T$ = 311,086 liters or 10,986 ft.$^3$
$V_T \approx$ 11,000 ft.$^3$

Consistently, the minimum theoretical retention time for the volume, $V_T$, having the through flow rate, F, is:

$$t = \frac{V_t}{F}$$

$$= \frac{11{,}000 \text{ ft.}^3 \times 7.48 \text{ gal/ft}^3}{800 \text{ gal/min}}$$

$$t = 102.84 \text{ min}$$

Regarding a single stage reaction apparatus to achieve the same end, it is convenient at this point to illustrate the comparative advantages of a two stage system, using either equation (3) or (4).

$V_{ss}$ = Total Single Stage Volume

-continued $$= \frac{F}{k}\left(\frac{C_i}{C_o} - 1\right)$$

$$= \frac{3028 \text{ liters/min.}}{0.2558 \text{ l/min}}\left(\frac{20}{0.1} - 1\right)$$

$$= 2{,}355{,}637 \text{ liters or } 83{,}191 \text{ ft.}^3.$$

Comparatively then:

$$\frac{V_{ss}}{V_T} = \frac{83{,}191}{11{,}000} = 7.56$$

In other words, it would require a total single stage reactor volume approximately 7.5 as large as the requisite two stage volume to reduce the $Na_2S$ concentration from 20 gm/liter to 0.1 gm/liter in an 800 GPM flow stream with the same 0.445 SCFM air/ft$^3$ liquor induced reaction rate constant of 0.2555 1/min.

Continuing with the two stage design example, from the initial premises:

$V_T = V_1 + V_2$ is a minimum when $$dV_T/dC_m = 0$$

If parameters $k_1 = k_2$, then $$V_1 = V_2 = V_{T/min}/2$$

To size the physical dimensions of a reaction vessel having the total volume $V_T$, it should be considered that the pilot quiescent liquor head was 9.4 ft. Since many factors such as reaction interface area between the gas bubbles and the liquor mass are pressure related, in order to have a realistic scale up, the full size vessel liquor head should be reasonably close to the pilot vessel liquor head. Accordingly, the full size vessel quiescent liquor head is empirically assigned a height of 10 ft. The diameter of the full size vessel therefore is:

$$D_T = \sqrt{\frac{4\,V_T}{h\pi}}$$

$$D_T = \sqrt{\frac{4 \times 11{,}000 \text{ ft}^3}{3.1416 \times 10 \text{ ft.}}}$$

$D_T = 37.4$ ft.

For practical considerations, an actual vessel height should be approximately 3 times the theoretical vessel liquor head to accommodate deaeration and stabilized sludge deposits below the gas nozzles and liquor expansion due to aeration and foaming above the gas nozzles.

Determining, next, the full size system air volume demand, the specific volume, $\sqrt{\ }$, of 0.445 SCFM air/ft.$^3$ liquor is simply proportionalized to the full sized 11,000 ft.$^3$ liquor volume. Accordingly, $V_s = V_t \times \sqrt{\ }$ $= 11{,}000$ ft$^3$ liquor $\times$ 0.445 SCFM air/ft$^3$ liquor $V_s = 4840$ SCFM It shall also be useful to consider the superficial percolation velocity of air through the pilot apparatus under the test conditions. This is defined as air volumetric flow rate at operating conditions at the nozzles divided by the actual cross-sectional area of the tower. The main importance of this criterion is as a reference parameter. As a matter of absolutes, however, a superficial percolation velocity of approximately 14 ft/min seems to be a maximum for the liquor species tested. Superficial velocities greater than 14 ft/min tend to generate too much foam due to agitation and transport excessive amounts of liquor from the tank inner volume to the foam tank due to excessive aeration.

Since superficial velocity is meaningful only relative to the operating conditions at the nozzle outlets, volumetric flow rate of air at standard conditions must be converted to that at the operating conditions. Cooperatively, the average specific gravity of heavy black liquor is 1.3 which gives a liquor head of 21.3 in to exert 1 psi.

From ideal gas law:

$$V_{op} = V_s \cdot P_s/P_{op} \cdot T_{op}/T_s$$

where:

$V_3$ = air volumetric flow rate at standard conditions $P_s$ = standard atmospheric pressure: 14.7 psia $T_s$ = standard temperature: 520° R $V_{op}$ = air volumetric flow rate at operating conditions at nozzle $P_{op}$ = operating pressure at nozzle $T_{op}$ = operating temperature of air is assumed to be that of liquor For pilot tower operation, $V_s^p = 208$ ft$^3$/min $P_{op}$ = 9.4 ft liquor head + 1.0 psi back pressure in top air space + 14.7 psia $= 9.4 \times 12/21.3 + 1 + 14.7 = 21.0$ psia $T_{op}^p = 200 + 460 = 660°$ R $V_{op}^p = 208 \times 14.7/520 \times 660/21.0$ $= 208 \times 0.888 = 184.80$ ft$^3$/min Also, the cross-sectional area of the pilot tower was 50 ft$^2$.

Therefore the superficial velocity used in the pilot tower is:

$$v_{sp}^p = \frac{V_{op}^p}{A^p} = \frac{184.8\ CFM}{50 \text{ ft.}^2} = 3.696 \text{ ft/min} < 14 \text{ ft/min/max}$$

Since the full-size tower will be using 4840 SCFM, the corresponding air volumetric flow rate at the specified operating conditions can be similarly determined by using ideal gas law.

For the full-size tower $V_s^F = 4840$ SCFM $$P_{op}^F = 10 \text{ ft liquor head} + \underbrace{2.0 \text{ psi back pressure in top air space}}_{} + \underbrace{14.7 \text{ psia atmospheric pressure}}_{}$$

$$= \frac{10 \text{ ft} \times 12 \text{ in/ft}}{21.3 \text{ in of black liquor/psi}} + 2.0 + 14.7 = 22.3 \text{ psia}$$

$$T_{op}^F = 200° \text{ F} + 460° \text{ R} = 660° \text{ R}$$

$$V_{op}^F = 4840 \times \frac{14.7}{520} \times \frac{660}{22.3} = 4840 \times 0.837 = 4049 \text{ ft}^3/\text{min}$$

Therefore for the full-size tower the superficial velocity of air is:

$$v_{sp}^{p} = \frac{V_{op}^{F}}{A_F} = \frac{4049\ \text{ft}^3/\text{min}}{1099\ \text{ft}^2} = 3.7\ \text{ft/min} < 14\ \text{ft/min/max}$$

The designed superficial velocity for the full-size tower is much less than the 14 ft/min maximum velocity experimentally determined. Therefore it is in the acceptable range.

It will be noted that no consideration has been given to excess discharge pressure required for downward penetration of the air jet stream. Such considerations are more appropriate for design refinement and are not necessary to the preliminary design decisions taught herein.

Turning next to the full size air flow distribution system, the gross design objective is to deliver and sustain even air flow to the liquor mass at the specified rate. As previously explained, these objectives are satisfied in the main by uniform pressure distribution with sufficient back pressure in the air system to prevent nozzle plugging.

Uniform pressure and flow distribution from a complex manifold system defies a purely analytical solution approach due to the complexity of flow effecting parameters. Accordingly, empirical solutions for various manifold system designs have been developed from experience. The solution found operative for the manifold system taught herein includes consideration of area ratios and length to diameter ratios.

The critical area ratio of this manifold system refers to the ratio between the total exit flow area, $A_{out}$, from the manifold conduit and the total flow area, $A_{in}$, of the manifold. This ratio should be equal to or less than 0.95 when the specified length to diameter ratio is satisfied. The length to diameter ratio of the manifold refers to the center line length, $L_m$, of the manifold conduit divided by the effective manifold diameter, $D_m$. This ratio is ideal around 70. Stated, mathematically, these two interrelated conditions are:

$$A_{out}/A_{in} \leq 0.95,$$

when $$L_m/D_m \simeq 70$$

To extend these relations one stop further when $$L/D \leq 70:$$

$$A_{out}/A_{in} \leq 0.95 \times L/D/70$$

Another empirical relation relevant to air distribution is that of the flow discharge velocity from the nozzle throats. Such velocity, $v_n$, should be within the range of 200 to 400 ft/sec.

From the aforedetermined total operational air flow rate, $V_{op}^F$, of 4049 ft³/min, an empirically selected nozzle size of 0.126 in² and a conservative 200 ft/sec nozzle velocity objective, a determination of the requisite total number of nozzles, N, may be obtained:

$$N = \frac{V_{op}^F}{A_n \times v_n}$$

$$= \frac{4049 \times 144}{0.126 \times 200 \times 60}$$

$$N = 386$$

Distributing the N number of nozzles over the tank cross-sectional area uniformly, we find that each nozzle should service 2.85 ft² of tank section: i.e., $$A_d = \frac{A_T}{N} = \frac{\pi D_T^2}{4N} = \frac{\pi(37.4)^2}{4(386)}$$

$$= \frac{1098}{386}$$

$$A_d = 2.85\ \text{ft}^2$$

By dividing the circular tank floor area into 24 radial segments, each segment respective to a subheader 24 we find that each subheader should support 16 nozzles; i.e., 386 nozzles × 1/24 subheaders = 16.08 nozzles/subheader.

Since only whole numbers of nozzles may be fabricated and the nozzle velocity selected for the assumed condition was the lower extremity of the recommended range, the number of nozzles assigned for each subheader shall be 16 thereby making the total number of nozzles for the system 384 and the distributed service area 2.86 nozzles/ft². The volumetric air flow rate per nozzle then becomes 10.54 ft³/min and the nozzle discharge velocity, $V_n$ becomes 201 ft/sec, within the 200–400 ft/sec working range.

Figure 5:
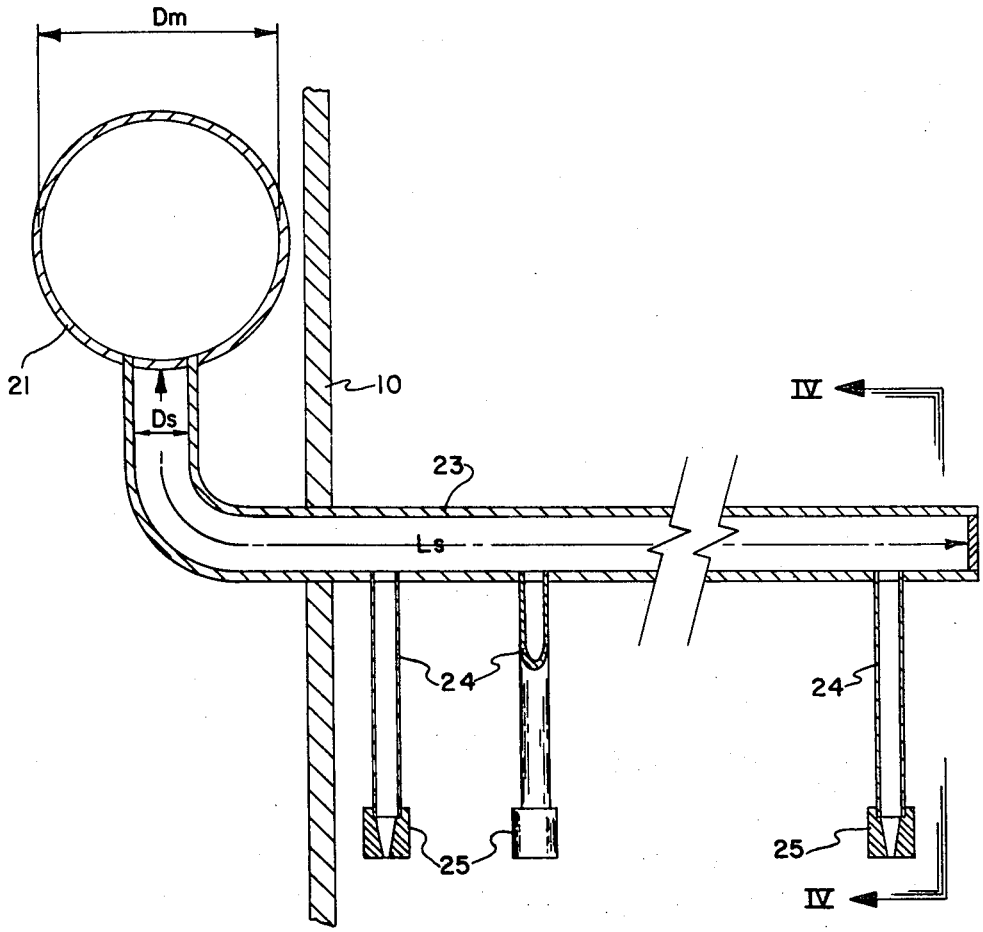
FIG. 5 is a sectional enlargement of the air supply manifold taken at section line V—V of FIG. 3.
Figure 6:
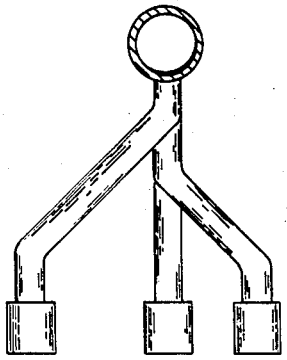
FIG. 6 is an end elevation of the air supply manifold taken at section line VI—VI of FIG. 5.

From the foregoing relations and referring specifically to FIGS. 5 and 6, the subheader diameter $D_s$ may be determined. Since the tank diameter, $D_T$ was found to be 37.4 ft, the greatest radial subheader length $L_s$ would be in the order of 18 ft. Therefore, assuming $L_s/D_s$ 70 and applying the critical $A_{out}/A_{in} \leq 0.95$ [ L/D/70 ] relation conservatively, with a 3 in schedule 40 subheader the L/D ratio is:

$$\frac{L_s}{D_s} = \frac{18\ \text{ft} \times 12\ \text{in/ft}}{3.07\ \text{in}} = 70.36$$

So, $$\frac{A_{out}}{A_{in}} = 0.95 \times \left[\frac{L_s/D_s}{70}\right] = 0.95 \times \frac{70.36}{70} = 0.955, \text{ and}$$

$$A_{outs} = .126\ \text{in}^2/\text{nozzle} \times 16\ \text{nozzles/subheader} = 2.016\ \text{in}^2/\text{subheader}$$

$$A_{ins} = \frac{\pi \times (3.07)^2}{4}\ \frac{\text{in}^2}{\text{subheader}} = 7.40\ \frac{\text{in}^2}{\text{subheader}}$$

$$\frac{A_{out}}{A_{in}}/s = \frac{2.016}{7.40} = 0.272$$

Since the 0.272 area ratio is less than the 0.95 [ $L_s/D_s/70$ ] maximum limit, the 3 in schedule 40 subheader may be used.

Although the nozzles 25 may be mounted on the subheader by 1 in schedule 40 conduits, 24, the flow area thereof was not considered in the area ratio relation since the effective exit area from the subheader is determined exclusively by the nozzle throat size.

Turning next to the mainheader 21 of the air manifold system, the same analytical process as applied above to the subheader 23 selection is used.

As determined thus far, the 3 in schedule 40 pipe selected as the subheader conduit 23 was found to have an effective flow area of 7.40 in$^2$. Since our design also provides for 24 such subheaders 23 from the mainheader 21, the total exit flow area, $A_{out}$ from the mainheader is:

$$A_{out} = 24 \times 7.40 = 177.6 \text{ in}^2$$

If an area ratio, $A_{out}/A_{in}$, equal to 0.95 maximum is relied upon, the minimum mainheader flow area may be determined:

$$A_{intmin} = A_{out}/0.95 = 177.6/0.95 \text{ in}^2$$

$$A_{intmin} = 187 \text{ in}^2$$

The diameter of a 187 in$^2$ pipe is 15.4 in. A 16 in schedule 30 pipe having a 15.25 in I.D. seems suitable.

Checking this 16 in pipe selection for the mainheader $L_m$ (FIG. 3) for the length to diameter ratio relation, the length of the mainheader will be taken as 122.5 ft, on the basis of 39 ft centerline diameter mainheader situated externally around the 37.4 ft diameter tank.

Accordingly, $$\frac{L_m}{D_m} = \frac{122.5 \text{ ft} \times 12 \text{ in/ft}}{15.25 \text{ in}} = 96.4$$

which is substantially greater than the ideal ratio of 70. Consequently, the 16 in pipe selection is not suitable due to L/D considerations.

As a second assumption for the mainheader size, a 24 in nominal diameter schedule 30 pipe having a $D_m$ = 22.88 in is taken. The larger pipe necessitates a larger circular diameter of 39.7 ft around the 37.4 ft diameter tank, e.g. $L_m$ = 124.7 ft.

Accordingly, $$\frac{L_m}{D_m} = \frac{124.7 \text{ ft} \times 12 \text{ in/ft}}{22.88 \text{ in}} = 65.4$$

As a final point of note, attention is directed to the elevational arrangement of the several air distribution system stages. Each horizontal portion is lower than the previous and no point in the system is lower than a subsequent point. In recognition of the fact that all systems are eventually stopped at some time when it is inconvenient to drain the tank 10 of liquor, this elevational arrangement permits the air system to be completely purged of backed up liquor by resumed air pressure.

Although we have described herein the preferred embodiment of our invention, it should be understood that numerous alternative embodiments within the scope of our invention will occur to those of ordinary skill in the art. For example, a radially extending plate baffle may be used as a partition 20 within tank 10 in lieu of the circular partition shown. If desired, 3 or more series contact stages may be used. Also, the relative flow sequence may be reversed by using the outlet piping 27 as the inlet for a countercurrent-co-current sequence. Moreover, by the use of manometer conduits, the flow sequence may be made co-current in both stages and still avoid the use of pumps.

Having fully disclosed our invention, we claim:

1. An apparatus for intimately contacting a flowing quantity of spent cellulose pulping liquor with a quantity of oxidizing gas, said apparatus comprising:

A. A vessel of substantially uniform sectional area from a bottom end to a top end along the height of a contact zone;

B. Partition means extending from the bottom end of said vessel for a portion of the height thereof and dividing the area of said section into at least two volumes, said two volumes communicating only above the top of said partition;

C. Liquor inlet means proximate of the bottom end of said contact zone within a first of said volumes;

D. Liquor outlet means proximate of the bottom end of said contact zone within a second of said volumes; and, E. Manifold conduit means disposed proximately of the bottom end of said contact zone for distributing said oxidizing gas in direct contact with said liquor over substantially all the area of said section, said manifold conduit means comprising a main header conduit having a flow length extending between a juncture point with an oxidizing gas supply conduit and a flow plug, a plurality of subheader conduits joining said main header serially along said flow length and penetrating both of said volumes, a plurality of gas discharge orifice means respective to each of said subheaders, joined thereto and positioned over the sectional area of both volumes to distribute substantially uniformly the discharge of oxidizing gas over said sectional areas, the mathematical ratio of areas between the total of all subheader flow sections and the main header flow section being approximately 0.95 or less when the ratio of said flow length to the effective flow diameter of said main header is approximately 70 or less.

2. An apparatus as described by claim 1 wherein the elevation of said manifold conduit means diminishes from said main header to said discharge orifice means.

3. An apparatus as described by claim 1 wherein the ratio of areas between the total of all discharge areas respective to all discharge orifice means served by any one of said subheaders and the flow section of a respective subheader is approximately 0.95 or less when the ratio of the subheader length to subheader diameter is approximately 70 or less.

4. An apparatus as described by claim 1 wherein said main header is a circular conduit, said flow plug being positioned on one side of said source conduit juncture.

* * * * *